United States Patent [19]

Pot

[11] 4,102,064

[45] Jul. 25, 1978

[54] SWELL COMPENSATOR FOR SUCTION DREDGING SYSTEM

[75] Inventor: Hendrik Pot, Alblasserdam, Netherlands

[73] Assignee: N.V. Industrieele Handelscombinatie Holland, Rotterdam, Netherlands

[21] Appl. No.: 721,048

[22] Filed: Sep. 7, 1976

[30] Foreign Application Priority Data

Sep. 5, 1975 [NL] Netherlands ..... 7510520

[51] Int. Cl.[2] ..... E02F 3/90

[52] U.S. Cl. ..... 37/67; 37/72; 37/66

[58] Field of Search ..... 37/67, 66, 72, 58

[56] References Cited

U.S. PATENT DOCUMENTS

| | | | |
|---|---|---|---|
| 3,579,872 | 5/1971 | Jantzen | 37/66 |
| 3,739,503 | 6/1973 | Barker et al. | 37/72 X |
| 3,777,376 | 12/1973 | Turner et al. | 37/67 |

FOREIGN PATENT DOCUMENTS

| | | | |
|---|---|---|---|
| 2,413,738 | 10/1974 | Fed. Rep. of Germany | 37/66 |

*Primary Examiner*—Clifford D. Crowder
*Attorney, Agent, or Firm*—Young & Thompson

[57] ABSTRACT

A suction dredging system comprises a vessel having an arm pivotally secured to it which can be positioned and held in an obliquely downwardly directed position and which itself comprises upper and lower parts which are pivotally interconnected with a link between them, the link making an angle with both parts of the arm so that motions of the upper part of the arm in the vertical plane are not or are hardly transmitted to the lower part of the arm by both parts of the arm. The lower part supports a suction mouth of a suction pipe as well as a rotary cutter whose shaft is disposed in the vertical plane of the arm, the lower part of the arm being stabilized by means of a hydropneumatic spring. A second hydropneumatic spring acts horizontally on the assembled link and lower part of the arm and cutter.

5 Claims, 10 Drawing Figures

SWELL COMPENSATOR FOR SUCTION DREDGING SYSTEM

The invention relates to a suction dredging system consisting of a vessel provided with an arm or ladder pivotally secured to it, which can be placed and held in an obliquely downwardly directed position, and which itself consists of an upper and a lower part which are pivotally interconnected with interpolation of a link making an angle with both parts of the ladder in such a manner that motions of the upper part of the ladder in the vertical plane are not or hardly transmitted to the lower part of the ladder by both parts of the ladder, which lower part supports the suction mouth of the suction pipe as well as a cutting member, and which lower part is stabilized by a hydro-pneumatic spring. A similar suction dredging system is known from the U.S. Pat. No. 3,777,376. With this known suction dredging system, the cutting member consists of a cutter of the type that can rotate around a shaft substantially extending in the vertical plane of the ladder. The hydro-pneumatic spring which should stabilize this lower part of the ladder is situated between the bottom end of the lower part of the ladder and the bottom end of the upper part of the ladder. This spring consists of a single-acting hydraulic cylinder which is coupled with a hydraulic-pneumatic cylinder or accumulator in the vessel which, on its pneumatic side, is connected to a compressed air supply, for instance, a compressor with a compressed air reservoir. Via a control valve, the pressure in the accumulator can be adjusted and, with that, the power exerted upon the bottom end of the lower part of the ladder by the hydraulic cylinder. Due to application of one or more accumulators and, consequently, modification of the air volume, the spring constant in this hydro-pneumatic spring may be modified. With this known system, part of the weight of the lower part with the cutting member is supported by the hydro-pneumatic spring. The remaining part should be supplied by the basic pressure which, naturally, is determined by the nature of the layer to be dredged. This known embodiment of the suction dredging system with a ladder consisting of two parts pivotally interconnected by means of a link aims at allowing motions of the vessel under the influence of the waves without these motions being disadvantageously transmitted to the cutting member so that, consequently, the latter will not hit the bottom or be rammed into the excavation, which might be detrimental to the cutting member and to the various suspension points of both ladder and suction pipe. With this known dredging system, the disposition of the link and the spring will allow ampler motions of the vessel in respect of the cutting member, as a result of which it will be possible to proceed also under worse weather conditions and, therefore, with high efficiency.

Now, with this known suction dredging system, the problem arises that, with a change in the nature of the layer to be dredged, that is, with a change in the basic pressure, it is not known exactly what becomes of the cutting member, which position it occupies and if the corresponding position of the suction mouth will be optimal. The fact is that, with a decrease of the basic pressure, the cutting member will sink away whereas it will creep upwards with a hardening of the layer. The sense of rotation of the cutting member also plays a part here. Furthermore, the whole is affected by the spring constant, that is, whether the spring will allow a large or merely a small stroke at a more or less constant pressure and consequent lifting capacity on the cutting member.

However, for an optimal functioning it will be essential to be acquainted with the position of the cutting member and, more particularly, not to have to worry about situations occurring with the cutting member and, preferably, not to have to make use of measuring equipment by means of which errors with respect to the required position may be ascertained and rectified. Such rectifications require time and energy.

The invention aims at improving this suction dredging system in such a manner that the aforesaid objections are met in the best possible way.

This may be achieved in different manners.

If the suction dredging system has a cutting member in the form of a cutter of the type that can rotate round a shaft substantially extending in the longitudinal axis of the lower part of the ladder, then, according to the invention, a second hydro-pneumatic spring may be mounted which can exert a power component in a horizontal direction on the assembled link, lower part of the ladder and cutting member. In this way, this combination is resiliently held in position in two manners, so that its position is better determined. This second spring is preferably situated between the link end turned away from the bottom end of the upper part of the ladder and the upper part of the ladder. In this manner, it is achieved that the lower end of the link is resiliently held in position which, however, will not impede the pivoting motions of the link. If, for instance, the layer to be dredged should become softer, the lower part of the ladder with the cutter can then no longer move backwards uncontrollably due to the link allowing such a motion unimpededly; the cutter may indeed sink farther away but will itself increase its resistance against such farther sinking away, the more so since, with a steeper position of the lower part of the ladder, the weight component on the bottom of said lower part will decrease. However, it will also be possible to stabilize the known embodiment with the hydro-pneumatic spring between the bottom end of the lower part of the ladder and the bottom end of the upper part by allowing the second spring to act upon the lower part of the ladder near the point of application of the first spring and, furthermore, to couple it with that part of the vessel situated before the ladder and above the lower part of the ladder, preferably in a direction obliquely away from the ladder. Due to the oblique position which is either present from the beginning or will develop in case of displacements of the lower part in a non-required direction, an extra horizontal component will develop which will attempt to keep the lower part of the ladder with the cutter in position.

According to the invention, it will now also be possible to hold both ends of the lower part of the ladder in position, and that by means of a spring between the upper part of the ladder and the link end turned away from that, and another spring between the bottom end of the lower part and that part of the vessel situated above it, again preferably in a direction obliquely turned away from the ladder. The latter spring will then support part of the weight of the lower part of the ladder and both have horizontally operating power components.

It will also be possible to approximate the solution of the problem stated above in an entirely different manner, in combination or not with the aforesaid dispositions of the springs, by applying an excavating wheel for a cutting member, the horizontal rotary shaft of which runs perpendicularly to the longitudinal axis of the lower part of the ladder. To a greater degree than a cutter, such an excavating wheel has the property of adjusting itself at a greater or lesser depth according to the basic pressure, the decreasing weight component on the spot of the excavating wheel also playing a part in case of a farther sinking away, and this excavating wheel has the property of supplying in itself a horizontal power component in the plane of the ladder, as a result of which unrequired displacements and the indetermination of the position of the cutter member will occur to a lesser degree than with a cutter. However, with an embodiment in which the former hydro-pneumatic spring is situated between the bottom end of the upper part and the bottom end of the lower part of the ladder in a known manner, it will be useful, also when applying an excavating wheel, to place a second hydro-pneumatic spring between the link end turned away from the bottom end of the upper part of the ladder and the upper part of the ladder. In the same manner as described above, this spring will then hold the link in position.

It will be understood that the force and spring constant of this second spring can be regulated in a manner corresponding to that with respectto the former hydro-pneumatic spring.

Also, it will be clear that the second spring can be placed in a manner corresponding to that described above with respect to the embodiment with a cutter, that is, between the bottom end of the lower part of the ladder and the vessel, both in combination with the known disposition of the former hydro-pneumatic spring and in combination with the arrangement according to the invention, between the bottom end of the link and the upper part of the ladder.

Finally, it will be clear that the active power components exerted by the springs, particularly horizontally and vertically, can also be affected by the direction in which the springs operate, consequently, by determination of the position of the points of application on the vessel, respectively on the upper part of the ladder.

Now, a particularly effective embodiment is obtained according to the invention when the link is directed horizontally and the lower part of the ladder connected to it vertically, the bottom end of the lower part of the ladder being resiliently coupled with the upper part of the ladder via a joint, horizontally connected to said bottom end and the top end of the lower part being directly resiliently connected with that part of the vessel preferably situated above it. In this manner, it is achieved that the lower part is acted upon exclusively by horizontal and vertical powers corresponding to the values of the powers occurring in the springs. The advantage of this is that modifications in the situation on the spot of the excavating wheel resulting in a change in one of the springs will affect the other as little as possible. In other words, the interaction of the springs is minimal.

According to the invention, it will also be possible, when applying an excavating wheel, to use one single spring only which may be the known spring in the arrangement between the bottom end of the lower part and the bottom end of the upper part of the ladder, but also merely the spring between the link end turned away from the upper part of the ladder and this upper part, or the spring between the bottom end of the lower part and the vessel. The working direction of the excavating wheel indeed plays a part here.

The invention will now be further illustrated with the aid of the drawings, in which:

FIG. 1 is a somewhat diagrammatic elevational view of a first embodiment of the suction dredging system according to the present invention; and FIGS. 2–10 are views similar to FIG. 1, but each showing a modified form of the invention.

All figures show a vessel 1 with a superstructure not further specified, which may be the same as that shown in the U.S. Pat. No. 3,777,376 and having a ladder which may be constructed in a manner as shown in said Patent, and which consists of an upper part 2, a lower part 3 and a link 4 pivotally connected with both parts and at such an angle with these parts that motions of the vessel 1 in the plane of the drawing can occur without difficulty.

The suction pipe 5 is merely shown schematically and the cutting member consists of a cutter 6 in the embodiment according to FIGS. 1, 2 and 3, and of an excavating wheel in the embodiment according to the other figures.

The embodiments according to FIGS. 1, 2, 4, 5 and 7 are supplied with a hydro-pneumatic spring 8 placed, operating and adjustable in the same manner as the spring 64 of the dredging system according to the U.S. Pat. No. 3,777,376.

In the embodiment according to FIG. 1, the hydro-pneumatic spring 9 is added to this combination known per se, which spring is situated between the bottom end 10 of the link and the top end 11 of the upper part 2 of the ladder. The securing to the upper part may also be effected at another place and the link otherwise directed, for instance upwards, but this will in no way alter the principle. This consists in that, with the resilient cylinder 9, force and spring constant can then be modified accordingly and the point 10 is resiliently held in position, as a result of which its position is determined.

With the embodiment according to FIG. 2, a second hydro-pneumatic spring 12 is disposed between the bottom end 13 of the lower part 3 of the ladder and the vessel 1, that is, this spring 12 is coupled with a point 14 situated forward of the ladder and preferably forward of the cutting member and is, therefore, directed obliquely upwards as a result of which the power supplied by this spring 12 not only will help support but, in case of horizontal displacements, will also supply a power component resisting such displacements.

In the embodiment according to FIG. 3, only the springs 9 and 12 respectively, applied in FIGS. 1 and 2 respectively, are present and the spring 8 is missing. The latter could be present but is in fact superfluous. By the springs 9 and 12, the lower part of the ladder is stabilized horizontally and vertically without this being detrimental to the motions of the vessel.

In the embodiment according to FIG. 4, the ladder as known from the U.S. Pat. No. 3,777,376 is modified to the extent that an excavating wheel 7 is applied instead of the cutter. This excavating wheel acts vertically upon the layer with a force equal to the total mass of the lower part of the ladder decreased by the vertical component of the power exerted by the spring 8, whereas a force acts upon the lower part in a horizontal direction as a result of the excavating operation of the excavating wheel itself. Due to this horizontal component operating in the vertical plane of the ladder, it is achieved that, in case of a change in the basic pressure (for instance when the soil should become softer), the vertical component will decrease due to the deep sinking, that, on the other hand, and the forward component resulting from the operation of the excavating wheel will increase with the result that the excavating wheel will more or less retain its place.

Due to this operation of the excavating wheel it will be possible to apply the possibilities of execution schematically shown in FIGS. 9 and 10, in which the spring 8 is entirely omitted and only the springs 9 or 12 are applied.

Naturally, however, it will also be possible to use the embodiment already shown in FIGS. 1, 2 and 3.

Figure 1:
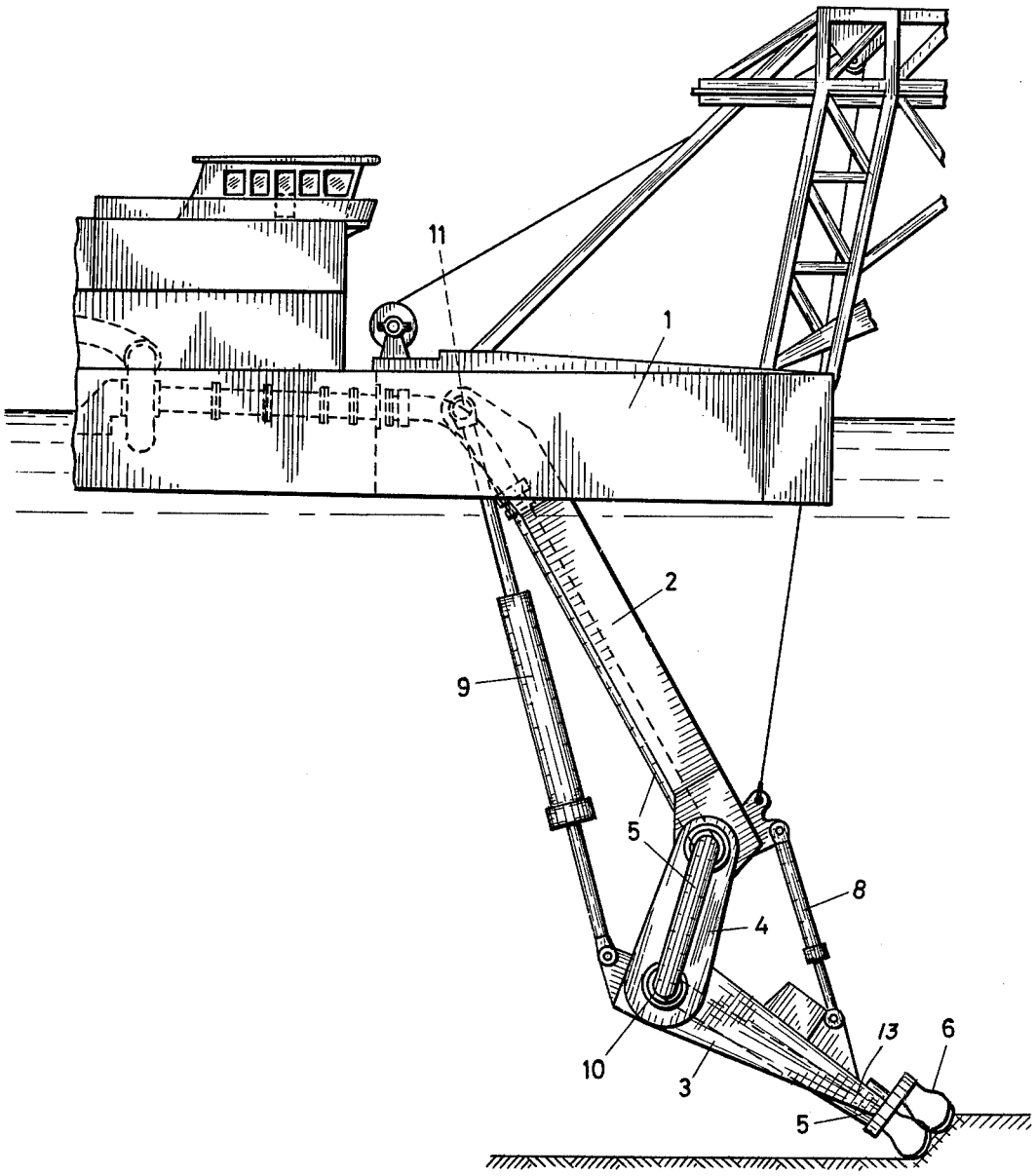
Figure 2:
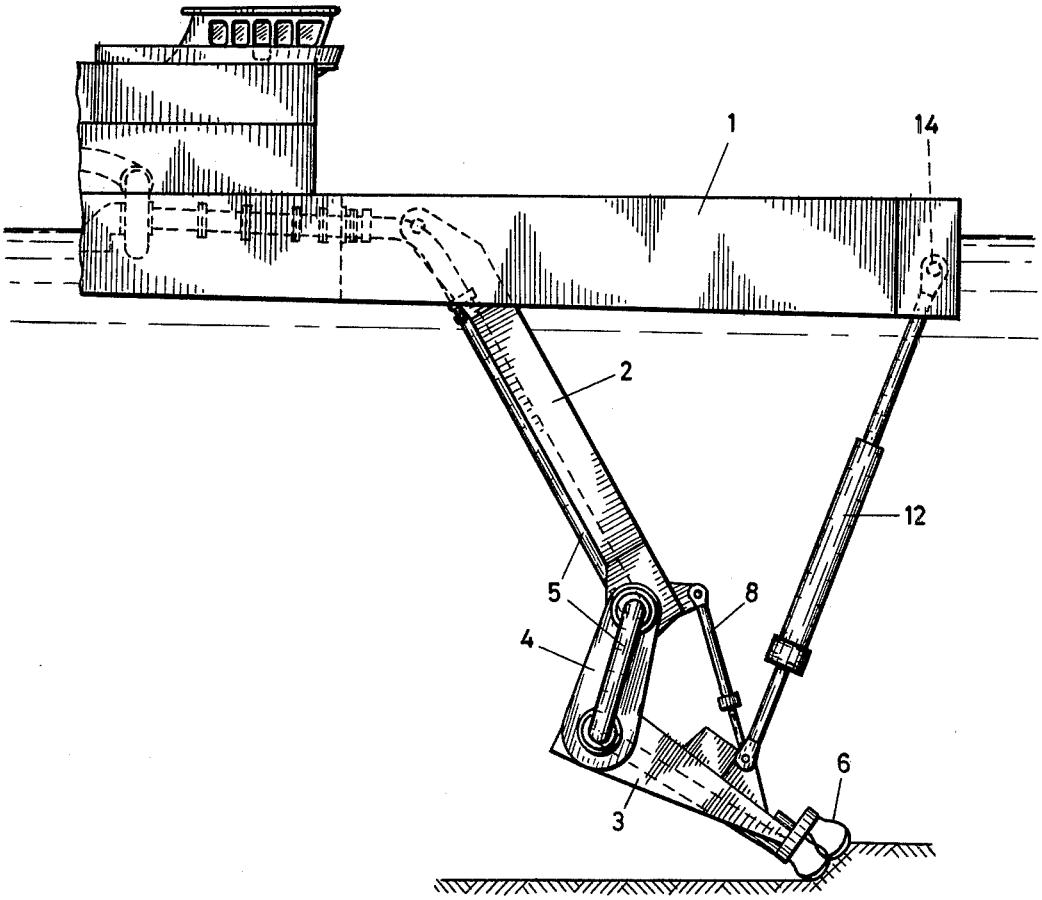
Figure 3:
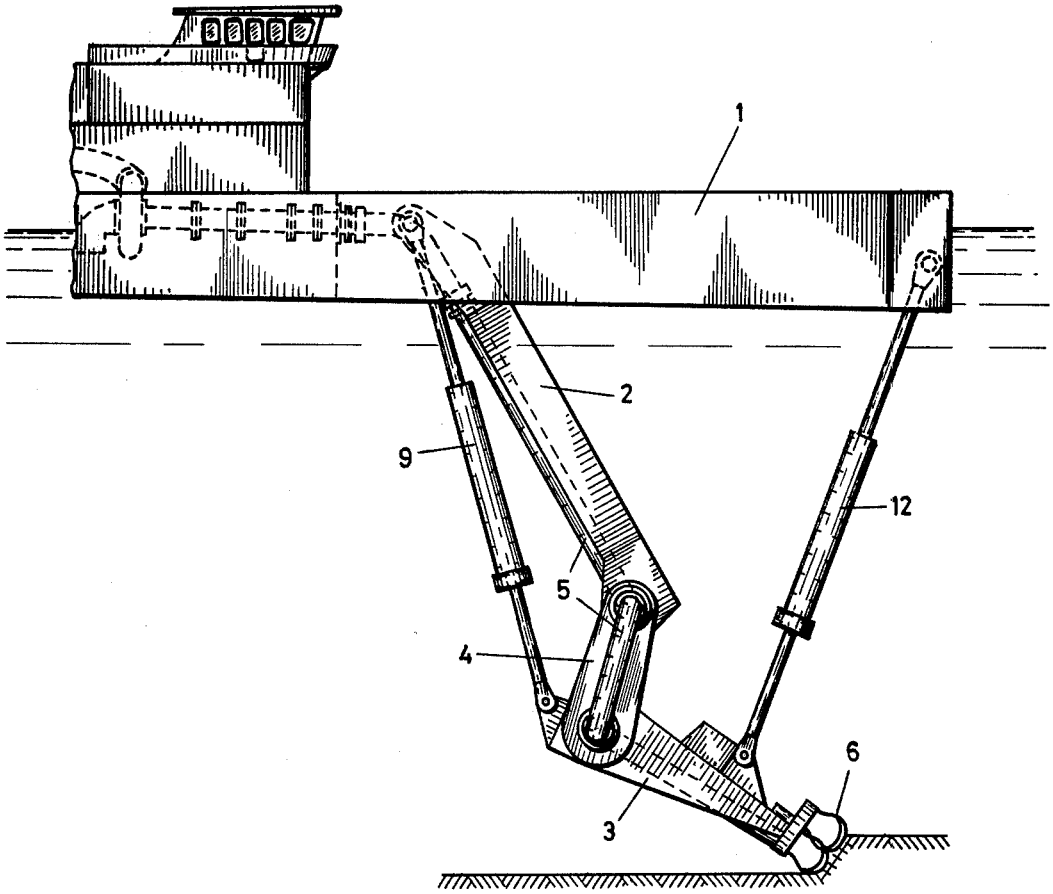
Figure 4:
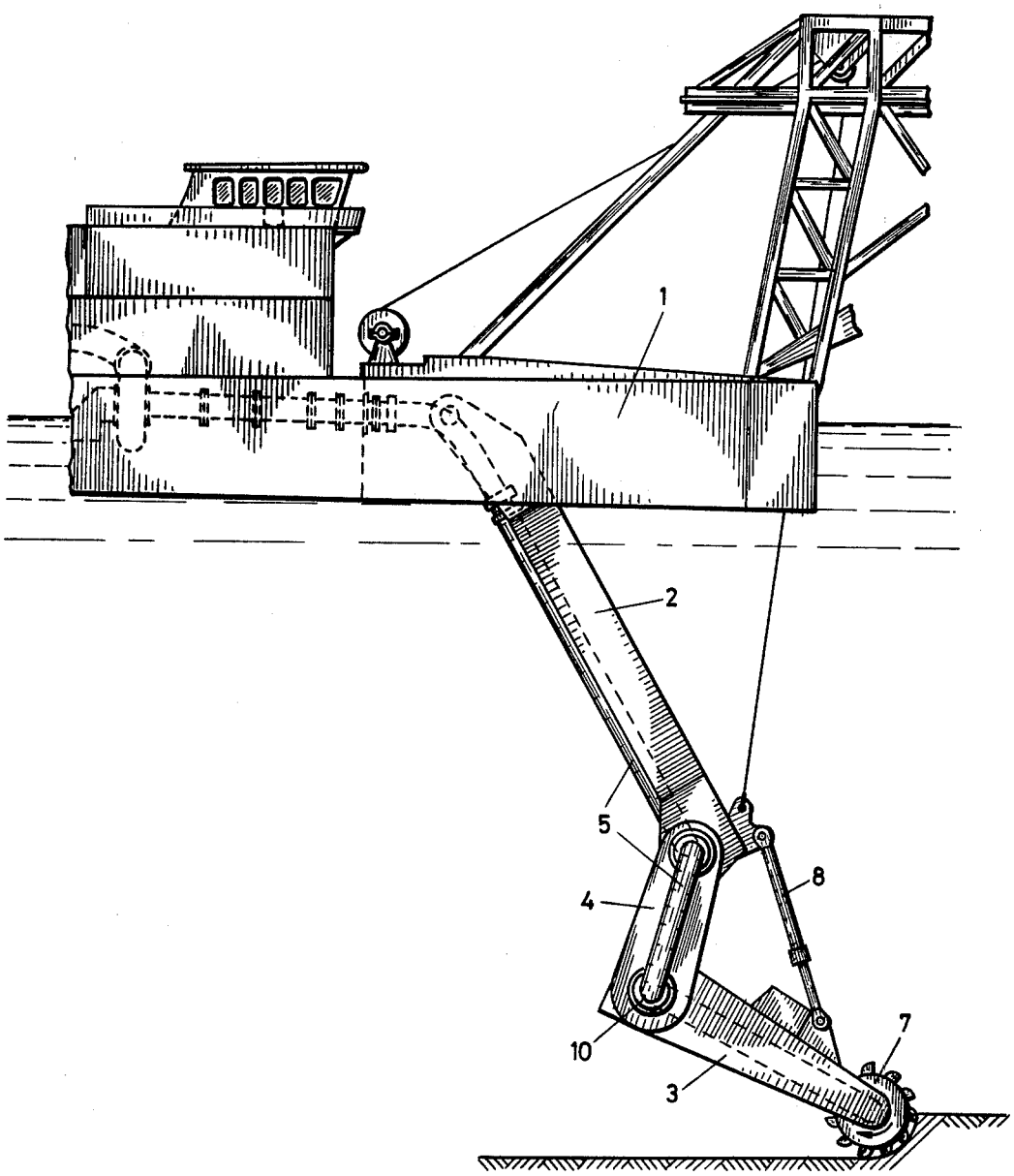
Figure 5:
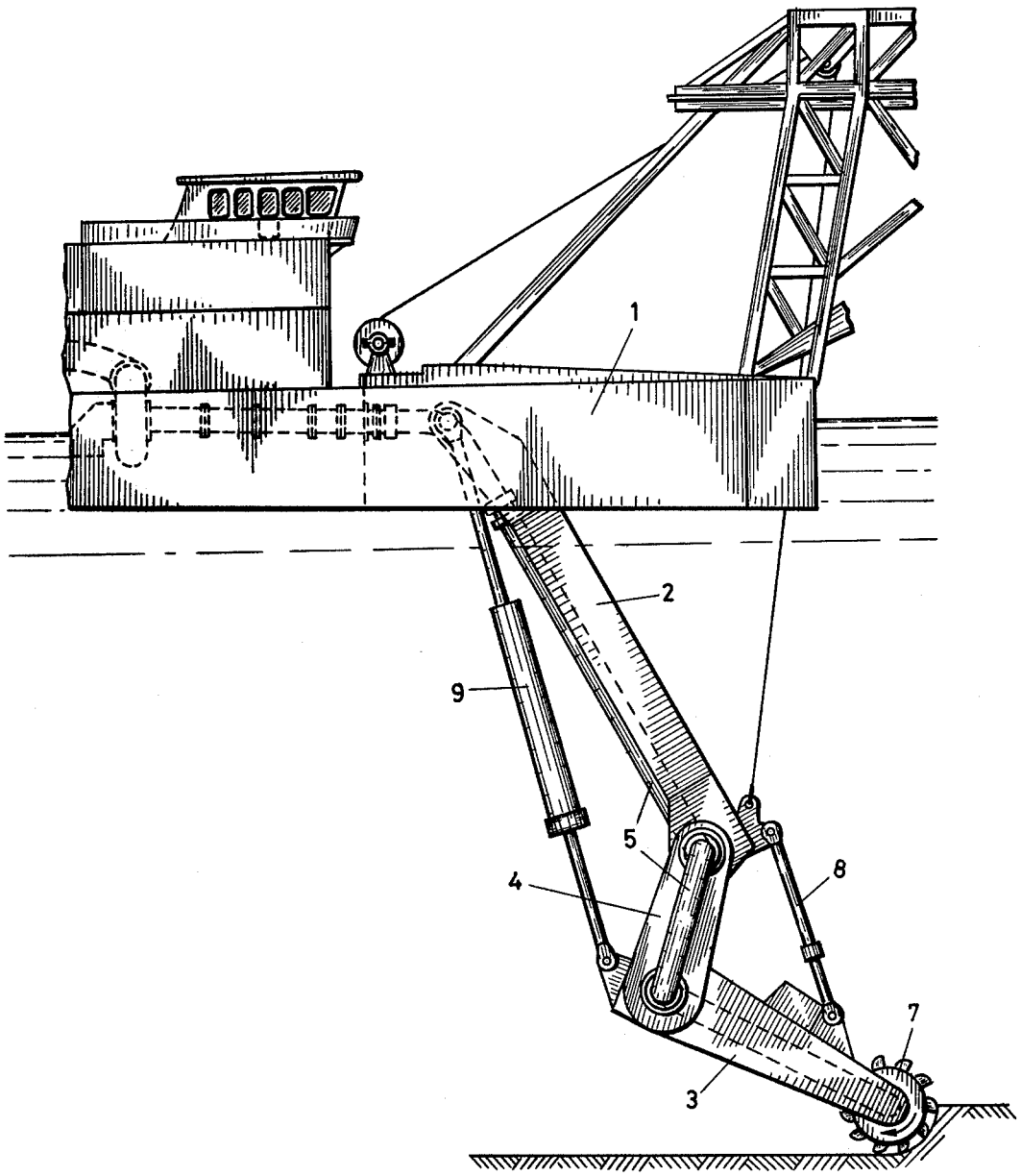
FIG. 5 shows a embodiment corresponding to that in FIG. 1.
Figure 6:
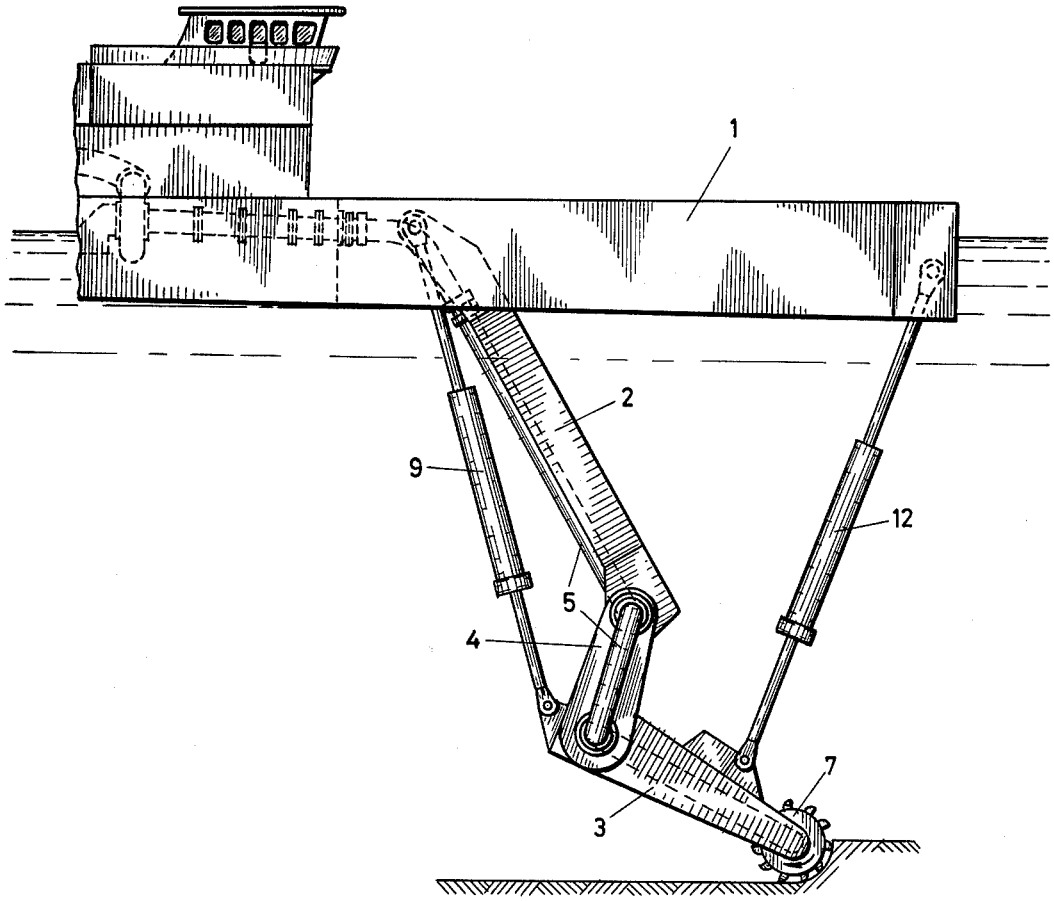
FIG. 6 shows the embodiment corresponding to that in FIG. 3
Figure 7:
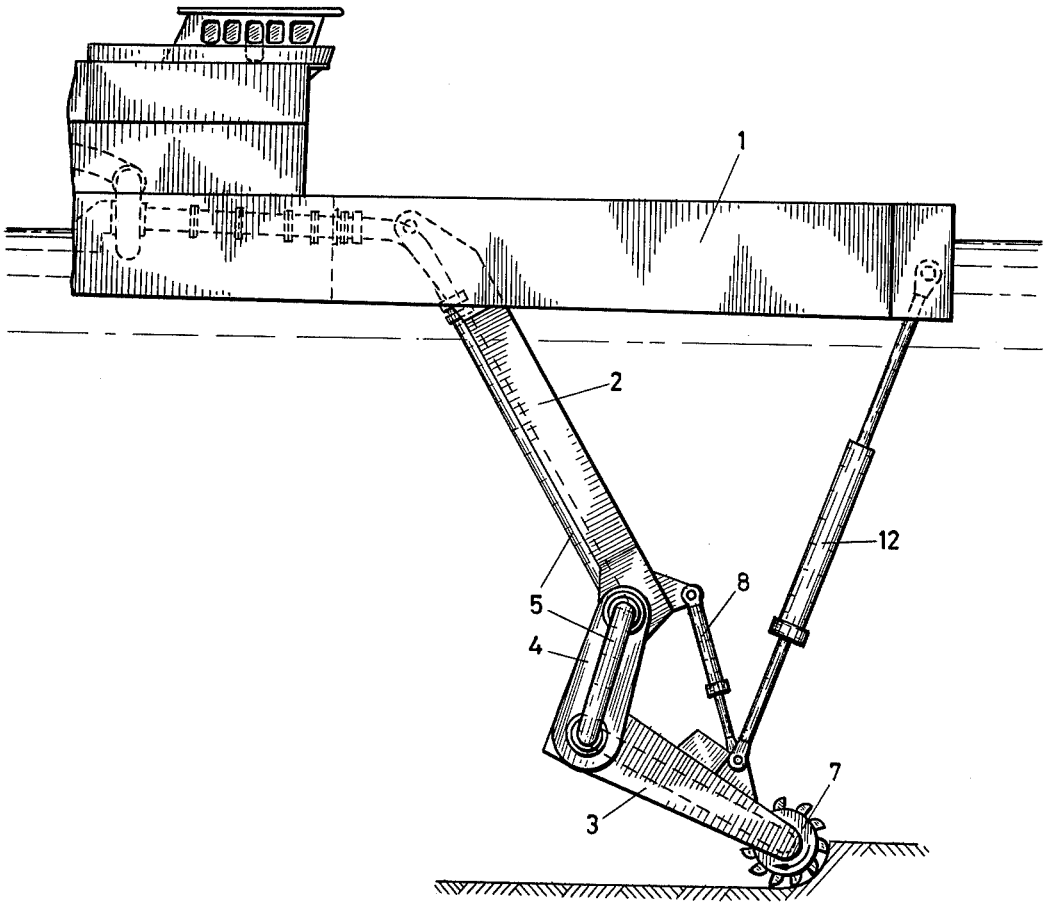
FIG. 7 shows the embodiment corresponding to that in FIG. 2.
Figure 8:
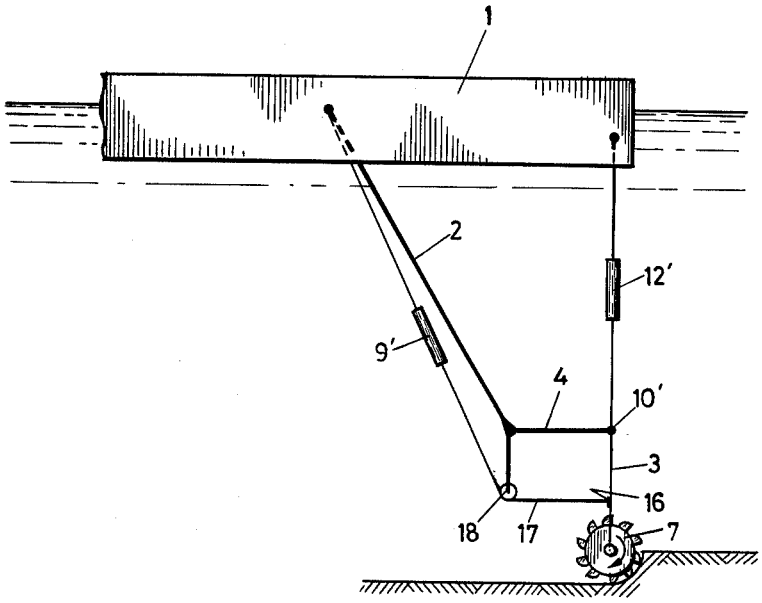
Figure 9:
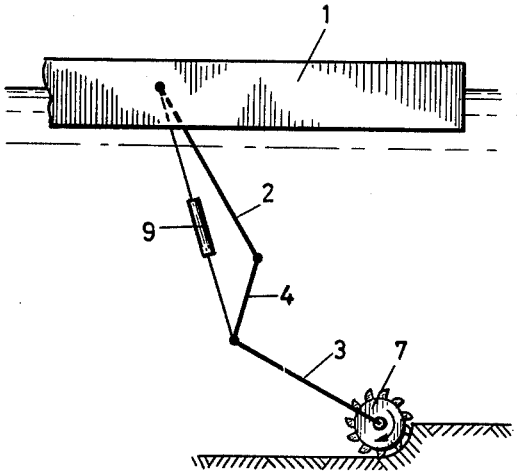
Figure 10:
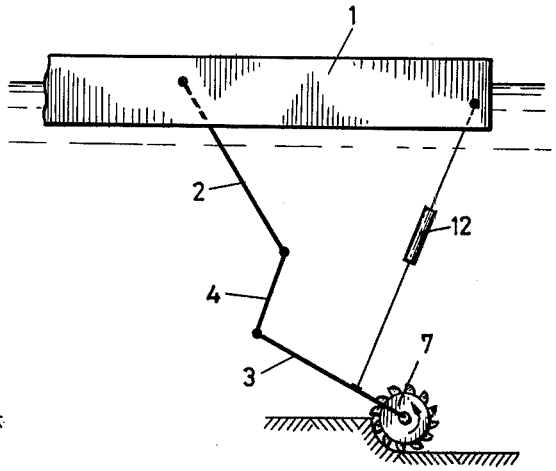

Finally, FIG. 8 shows a special embodiment. With this embodiment, the link 4 of the ladder is directed horizontally and the lower part 3 of the ladder is directed vertically. The top end 10' thereof is now vertically suspended from the vessel 1 via a spring 12' whereas, at 16, the bottom end of the lower part 3 is coupled with the spring 9' via a cable 17, which cable runs over a diverting pulley 18 or such-like. Consequently, the power of the spring 9' acts horizontally upon the lower part and that of the spring 12' vertically upon said lower part. Therefore, the link is now not held in position horizontally but vertically and the lower part is not held in position vertically but horizontally which, in principle, does not in any way alter the situation.

It will be clear that, apart from the possibilities represented, a considerable number of further variants are conceivable. Thus it, is quite possible to place both springs along the upper part of the ladder or to secure them to said upper part respectively and to connect them to the lower part in such a manner that the required horizontal and vertical power components are exerted in order to keep the cutting member optimally in position and, at the same time, to maintain the resilient knee-pivoting motion.

Furthermore, it is observed that, with all embodiments according to FIGS. 4–10, the excavating direction of the excavating wheel may also be the reverse, in which case the slope is excavated in an upward direction. The gravity is then positively made use of when collecting the soil cut off by the excavating wheel while the spilled matter is being shifted to the next cut. Naturally, reversal of the excavating direction will also cause a change in direction of the forces of reaction generated by the excavating wheel. However, this will in no way alter the fundamental intention of the various measures described in the foregoing as the hydro-pneumatic springs can also be so constructed as to absorb tension instead of pressure and can also be operative in opposite directions.

I claim:

1. In a suction dredging system comprising a vessel having an arm or ladder pivotally secured to it about a horizontal axis, which can be placed and held in an obliquely downwardly directed position and which itself comprises an upper and a lower part which are pivotally interconnected about spaced horizontal axes by a link that makes an angle with both parts of the ladder in such a manner that motions of the upper part of the ladder in a vertical plane are hardly transmitted to the lower part of the ladder, the lower part of the ladder supporting the suction mouth of a suction pipe and a cutting member of the type that rotates around a shaft substantially extending in the vertical plane of the ladder, and a pair of hydropneumatic springs acting between said lower part of the ladder and another portion of said dredging system; the improvement in which said springs lie in different planes parallel to said horizontal axes.

2. A system as claimed in claim 1, in which one said spring extends between the bottom end of the lower part of the ladder and the bottom end of the upper part of the ladder, the other said spring extending between the end of said link that is connected to the lower part of the ladder and the upper part of the ladder.

3. A system as claimed in claim 1, in which one said spring extends between the bottom end of the lower part of the ladder and the bottom end of the upper part of the ladder, the other said spring extending between the lower part of the ladder and that part of said vessel which is situated above it.

4. A system as claimed in claim 1, in which one said spring extends between the bottom end of said link and the upper part of the ladder, the other said spring extending between the lower end of the lower part of the ladder and said part of the vessel situated above it.

5. A system as claimed in claim 1, in which said cutting member is an excavating wheel that rotates about an axis parallel to said horizontal axes.

* * * * *